US008007194B2

(12) United States Patent
Wheeler

(10) Patent No.: US 8,007,194 B2
(45) Date of Patent: Aug. 30, 2011

(54) CAR WASHING APPLIANCE

(76) Inventor: Ronald Keither Wheeler, Detroit, MI (US)

( * ) Notice: Subject to any disclaimer, the term of this patent is extended or adjusted under 35 U.S.C. 154(b) by 0 days.

(21) Appl. No.: 11/824,985

(22) Filed: Jul. 3, 2007

(65) Prior Publication Data

US 2008/0047594 A1 Feb. 28, 2008

Related U.S. Application Data

(60) Provisional application No. 60/818,705, filed on Jul. 5, 2006.

(51) Int. Cl.
*B43K 8/10* (2006.01)

(52) U.S. Cl. ..... 401/201; 401/196

(58) Field of Classification Search ..... 401/6–8, 401/196, 200, 201
See application file for complete search history.

(56) References Cited

U.S. PATENT DOCUMENTS 4,457,640 A * 7/1984 Anderson ..... 401/7
4,515,703 A * 5/1985 Haq ..... 15/104.93
5,326,610 A * 7/1994 Moss ..... 428/78
5,609,431 A * 3/1997 Carroll ..... 401/201
6,926,339 B2 * 8/2005 Gentile ..... 296/136.07

* cited by examiner

*Primary Examiner* — David J Walczak
(74) *Attorney, Agent, or Firm* — The Weintraub Group, P.L.C.

(57) ABSTRACT

A car washing appliance has first and second cotton sheets which are joined together about their respective edges to cooperate to define a cavity therewithin. An opening in one of the sheets enables access to the cavity in which is deposited a quantity of detergent. Preferably, the detergent is a dishwashing detergent. The present invention further contemplates disposing a grid-like member or screen within the cavity onto which the detergent is deposited which, in turn, acts as a time release for the detergent. Preferably, the detergent is a dishwashing detergent or gel.

2 Claims, 1 Drawing Sheet

FIG 1
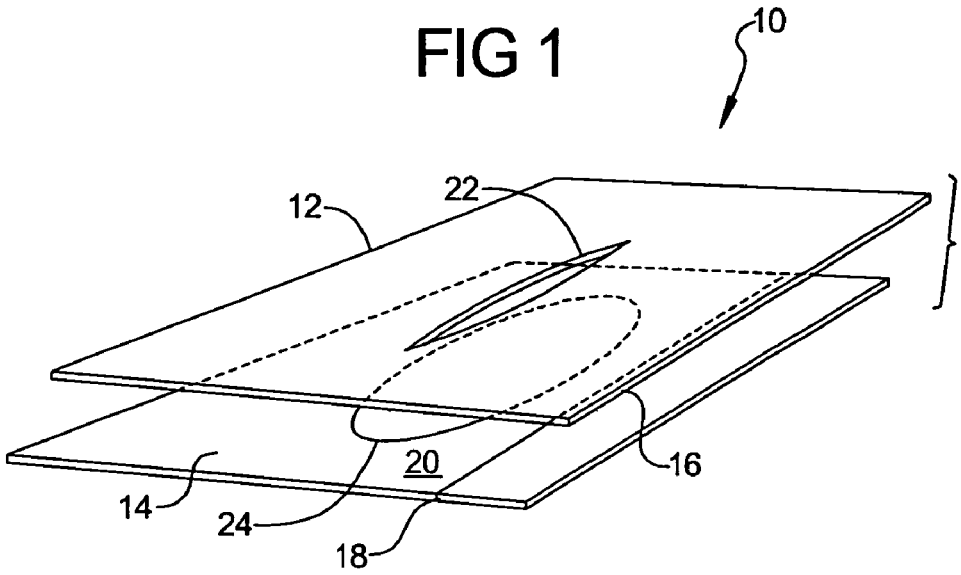
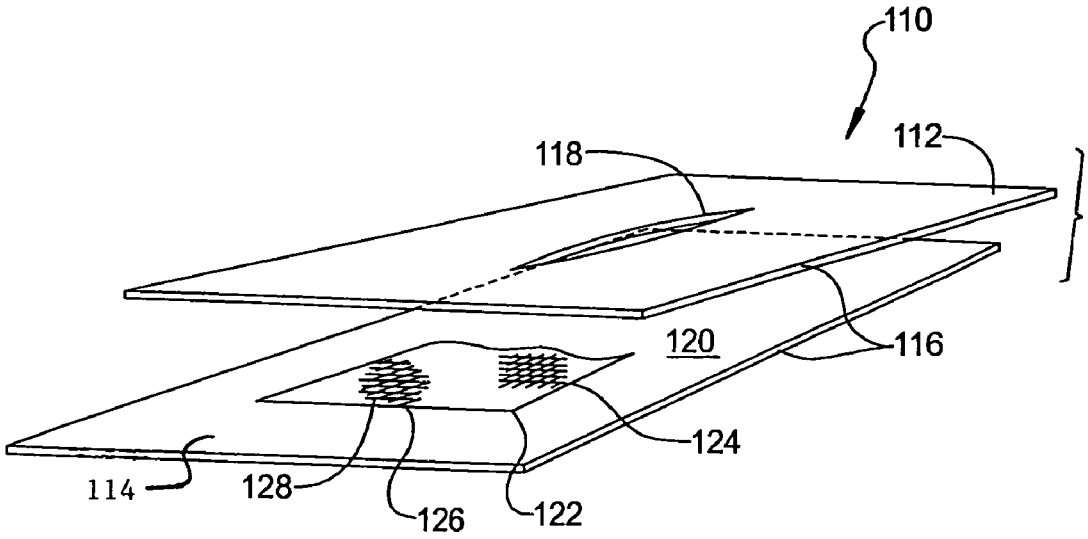
FIG 2

CAR WASHING APPLIANCE

CROSS-REFERENCE TO RELATED APPLICATION

This application is a completion application of co-pending U.S. Provisional Patent Application Ser. No. 60/818,705 filed Jul. 5, 2006 for a "Car Washing Appliance," the entire disclosure of which is hereby incorporated by reference.

BACKGROUND OF THE INVENTION

1. Field of the Invention

The present invention concerns appliances for washing cars and other vehicles. More particularly, the present invention concerns appliances or devices for manually washing automobiles and similar vehicles. And even more particularly, the present invention concerns appliances or devices for manually washing cars and similar vehicles in an auto wash environment.

2. Prior Art

As is known to those skilled in the art to which the present invention pertains, recently there has been a proliferation of "hand wash" vehicle or automobile washing emporiums or car washes. The purpose of such hand washes or washing is to preclude the scratching of vehicles ordinarily encountered with automated car washes which utilize coarse brushes or the like. Furthermore, by hand washing the vehicle, the user is able to wash those areas of the vehicle which are not ordinarily reached or touched by the mechanical or automated devices found in conventional auto washes. The mechanical devices have a predetermined route or track which they follow and which does not account for the particular contours of each vehicle, since each vehicle has its own styling which, while following certain conventional norms, has its own unique styling characteristics. Thus, in order to effectively wash the entire vehicle, it is necessary that these particular contours be contacted with the washing device. However, in order to be effective in a car wash environment, it is essential that any manually employed devices or appliances used for the car washing operation be sufficiently impregnated with the "soap" that constant refilling or impregnation of same be eliminated.

While the art has taught soap impregnated washing appliances such as found in U.S. Pat. Nos. 6,048,407; 6,209,165; 3,581,447; 5,704,723; 4,456,640; 2,669,737, none of the prior art devices are directed to vehicular washing.

It has been found that using a normal or conventional car washing detergent, while effective, simply does not have sufficient concentration in order for it to be efficacious in a commercial hand washing operation. Therefore, it is necessary to find a more concentrated detergent which can effectively clean multiple cars during a "shift".

As is subsequently detailed hereinafter, the present invention provides a car washing appliance or device which effectively achieves this.

SUMMARY OF THE INVENTION

In accordance herewith there is provided a car washing appliance which, generally, comprises:

(a) a first layer or sheet of a cotton material, the first sheet having a perimetral edge, (b) a second layer or sheet of a cotton material, the second sheet having a perimetral edge, the first and second layers being joined about the respective perimetral edges to define a cavity therebetween.

One of the sheets has an opening provided therein to enable access into the cavity.

A quantity of a detergent is disposed within the cavity. It is replenishable as it is consumed during car washing procedures.

Preferably, the detergent used herein is a dishwashing detergent or gel.

In an alternate embodiment hereof, a grid or screen-like member is disposed within the cavity and the detergent is deposited thereon and essentially fills the voids of the grid to entrap the detergent therewithin in a time-release mode.

A car washing appliance in accordance herewith, generally, comprises: A first layer of a cotton material, a second layer of a cotton material, the first and second layers being joined about the respective perimetral edges to define a cavity therebetween.

One of the sheets has an opening provided therein to enable access into the cavity.

A quantity of a detergent is disposed within the cavity. It is replenishable as it is consumed during car washing procedures.

Preferably, the detergent used herein is a dishwashing detergent or gel. Such compositions generally include at least one ionic as well as non-ionic surfactants.

In an alternate embodiment hereof, a grid or screen-like member is disposed within the cavity and the detergent is deposited thereon and essentially fills the voids of the grid to entrap the detergent therewithin in a time-release mode.

For a more complete understanding of the present invention reference is made to the following detailed description and accompanying drawing. In the drawing like reference characters refer to like parts throughout the several views in which:

BRIEF DESCRIPTION OF THE DRAWINGS

FIG. 1 is an exploded perspective view of first embodiment of a car washing appliance in accordance herewith, and FIG. 2 is an exploded perspective view of an alternate embodiment hereof.

DESCRIPTION OF THE PREFERRED EMBODIMENTS

At the outset, it should be noted, that although the ensuing discussion will be made with reference to a certain class of generic detergents, it is to be understood that car wash detergents can be used, but are not as effective.

In accordance herewith, and as shown in the drawing, and with particular reference to FIG. 1, there is provided a car washing appliance, generally, denoted at 10, which comprises a first layer or sheet 12 of a cotton material, a second layer or sheet 14 of a cotton material, the sheets being joined together at and about their respective perimetral edges 16, 18 to define a cavity 20 therebetween. One of the sheets 12 or 14 has an opening 22 provided therein to enable access into the cavity. A quantity 24 of a conventional "dishwashing" liquid or gel is deposited within the cavity.

It has been found that dishwashing detergents are more concentrated than conventional car washing detergents and, therefore, have a longer lasting life to enable efficacious washing of multiple vehicles.

Dishwashing detergents or gels are well known and commercially available and sold under a veritable plethora of trademarks. Dishwashing detergents are described in the prior art, such as is found in U.S. Pat. No. 6,602,838 and U.S. Pat. No. 6,586,385, the disclosures of which are hereby incorporated by reference.

Typically, dishwashing detergents contain at least one anionic surfactant and may include in addition thereto nonionic surfactants, which are generally ethylene oxide and/or propylene oxide adducts of polyhydric compounds, alkanolamides, amine oxides, zwitterionic surfactants and the like as well as sequestrates, etc.

It is to be noted with respect hereto that it is not any specific detergent which is adapted for use herein, but any of the well-known and commercially available dishwashing detergents can be used. What is essential hereto is that the detergent be either a liquid or a gel.

While the present invention enjoys particular efficacy with a dishwashing detergent, this does not preclude the use of other commercially available liquid or gel-like detergent.

A suitable and replenishable quantity of this detergent is what is deposited into the cavity 20.

With more particularity, the first layer 12 comprises a sheet of a cotton material and, is, preferably, terrycloth. A second layer or sheet 14 is of the same terrycloth material.

The layers 12 and 14 are bound together along their respective perimetral edges 16 and 18 by any suitable mode, such as by sewing or the like. The sheets cooperate to define the cavity or interior 20 therebetween.

Either one of the sheets 12 or 14 may have the opening 22 formed therein to enable access into the interior or cavity 20.

Once the replenishable quantity of detergent 24 is deposited within the cavity the device or appliance 10 hereof is defined.

In use, the device is wetted with water to put the detergent into the solution to enable it to wash a car or similar vehicle.

It is to be noted with respect hereto that the terrycloth is chosen because of its ability to contact the metallic surface without scratching the paint.

As hereinabove noted, it is preferred that the detergent be a dishwashing detergent because of its high concentration and ability to wash multiple vehicles without the need to instantly replenish the quantity of detergent disposed within the cavity. However, other types of liquid or gel detergents can be used herein.

It is apparent from the preceding that there has been described herein a cleaning appliance or device particularly adapted for cleaning automobiles which is efficacious and enables an efficient disposition thereof in a hand wash business environment.

Referring now to FIG. 2, there is depicted therein an alternate embodiment of the present invention and, generally, denoted at 110.

According to this embodiment, there is provided first and second layers or plies of terrycloth 112, 114 respectively. As with the first embodiment, the layers or plys are joined along the respective perimetral edges as at 116.

One of the layers 112 or 114 has an opening 118 formed therein.

Again, the two layers cooperate to define an interior cavity 120 therebetween. Disposed within the cavity 120 is a porous member 122, such as a porous plastic member 124 having a plurality of pores or openings 126. The pores or openings are macroscopic and are of the size to retain a quantity of liquid detergent or gel detergent attempting to pass therethrough. In other words, the detergent, because of the surface tension remains within the pores until contacted with water or other solvent.

In other words, the openings are of a dimension to retain or trap a quantity of detergent therewithin. In essence, the member 122 is analogous to a screen-like member having small macroscopic openings arrayed.

In accordance herewith, a quantity of detergent is deposited onto the screen and spread thereover. Because of the entrapment of the detergent within the openings or pores of the screen there is an effect a "time release" of detergent as the appliance is used.

It is to be appreciated from the preceding that there has been described herein a car washing appliance that precludes scratching a vehicle surface while effectively cleaning.

The invention claimed is:

1. A car washing appliance comprising:

a first layer of terrycloth material, the first layer having a perimetral edge, a second layer of terrycloth material, the second layer having a perimetral edge, the first and second layers being bound together along the entirety of their respective perimetral edges, the layers defining a cavity therebetween, a quantity of detergent disposed within the cavity, a planar screen-like member centrally disposed within the cavity, the detergent being deposited onto the planar screen-like, and wherein at least one of the layers has an opening therein which is located medially on a substantially planar surface of the at least one layer, and the opening permits access to the cavity; wherein the opening permits replenishing of the detergent to render the appliance reusable.

2. The appliance of claim 1 wherein the detergent is selected from the group consisting of a dishwashing liquid and a dishwashing gel.

* * * * *

UNITED STATES PATENT AND TRADEMARK OFFICE

CERTIFICATE OF CORRECTION

PATENT NO. : 8,007,194 B2
APPLICATION NO. : 11/824985
DATED : August 30, 2011
INVENTOR(S) : Ronald Keith Wheeler It is certified that error appears in the above-identified patent and that said Letters Patent is hereby corrected as shown below:

On the title page, item (76) inventor: delete "Ronald Keither Wheeler" and insert --Ronald Keith Wheeler--

Signed and Sealed this
Thirteenth Day of October, 2015

Michelle K. Lee

Michelle K. Lee
*Director of the United States Patent and Trademark Office*